US008662973B1

(12) United States Patent
Sorrell

(10) Patent No.: US 8,662,973 B1
(45) Date of Patent: Mar. 4, 2014

(54) METHOD AND APPARATUS FOR TRACKING MOVEMENT OF A BALL

(76) Inventor: Roger Lynn Sorrell, Raleigh, NC (US)

( * ) Notice: Subject to any disclaimer, the term of this patent is extended or adjusted under 35 U.S.C. 154(b) by 3241 days.

(21) Appl. No.: 11/072,543

(22) Filed: Mar. 4, 2005

Related U.S. Application Data

(60) Provisional application No. 60/550,476, filed on Mar. 5, 2004.

(51) Int. Cl.
*A63F 9/24* (2006.01)

(52) U.S. Cl.
USPC ..... 463/2; 463/3; 473/407; 473/570

(58) Field of Classification Search
USPC ..... 473/407, 353, 131, 151–156, 351, 35, 473/406, 570, 571, 198, 199; 463/2, 3
See application file for complete search history.

(56) References Cited

U.S. PATENT DOCUMENTS

| | | | | |
|---|---|---|---|---|
| 3,782,730 | A * | 1/1974 | Horchler | 473/353 |
| 5,507,485 | A * | 4/1996 | Fisher | 473/407 |
| 5,910,057 | A * | 6/1999 | Quimby et al. | 473/353 |
| 6,456,938 | B1 * | 9/2002 | Barnard | 701/213 |
| 6,524,199 | B2 * | 2/2003 | Goldman | 473/353 |
| 6,634,959 | B2 * | 10/2003 | Kuesters | 473/353 |
| 6,666,741 | B1 * | 12/2003 | Wilson | 446/175 |
| 6,908,404 | B1 * | 6/2005 | Gard | 473/407 |
| 7,188,498 | B2 * | 3/2007 | Browne et al. | 72/62 |
| 2002/0151994 | A1 * | 10/2002 | Sisco | 700/91 |
| 2002/0188359 | A1 * | 12/2002 | Morse | 700/91 |
| 2004/0073325 | A1 * | 4/2004 | Reeves | 700/91 |
| 2005/0012023 | A1 * | 1/2005 | Vock et al. | 250/206.1 |

* cited by examiner

*Primary Examiner* — Pierre E Elisca
(74) *Attorney, Agent, or Firm* — Coats and Bennett, P.L.L.C.

(57) ABSTRACT

A data collection and analysis system tracks motion of ball for analysis of a competitor's performance in a sport, such as golf or baseball. The data collection and analysis system comprises a ball equipped with a positioning receiver and a transmitter to acquire and transmit position data, and a handheld unit to receive and process the position data.

15 Claims, 2 Drawing Sheets

METHOD AND APPARATUS FOR TRACKING MOVEMENT OF A BALL

This application claims priority to U.S. Patent Application No. 60/550,476, filed on Mar. 5, 2004, which is hereby incorporated by reference herein in its entirety.

BACKGROUND OF THE INVENTION

The present invention relates generally to a method and apparatus for collecting data to analyze a person's performance in a sport, and more particularly to a method and apparatus to collect data tracking the movement of a golf that has been struck or hit.

Hand-held devices for collecting data regarding a golf round are known. For example, U.S. Pat. Nos. 5,740,077 to Reeves; 5,779,566 to Mullins; and 5,664,880 to Johnson et al., disclose hand-held devices equipped with GPS receivers that can store the position of a golf ball at the beginning and end of each golf stroke. Some of these devices can display distance to the green or other feature as an aid to the golfer during play. Some of these devices also include processors that analyze the golfer's performance and provide performance results to the user. For example, some such devices will give the golfer the average distance for each club used by the golfer. While the golfing computers known in the art are useful, there are no known golfing computers that provide accurate information regarding the flight path or motion of the ball. At most, prior art devices show the starting and ending points for each stroke but do not show the path traveled by the ball in getting from the starting point to the ending point. It would be useful if information regarding the flight path or path of travel of the ball could be recorded for subsequent use by the golfer in analyzing a round of golf.

SUMMARY OF THE INVENTION

A data collection and analysis system tracks motion of a ball for analysis of competitor's performance in a sport, such as golf or baseball. The data collection and analysis system comprises a ball equipped with a positioning receiver and a transmitter to acquire and transmit position data, and a hand-held unit to receive and process the position data.

DETAILED DESCRIPTION OF THE INVENTION

Figure 1:
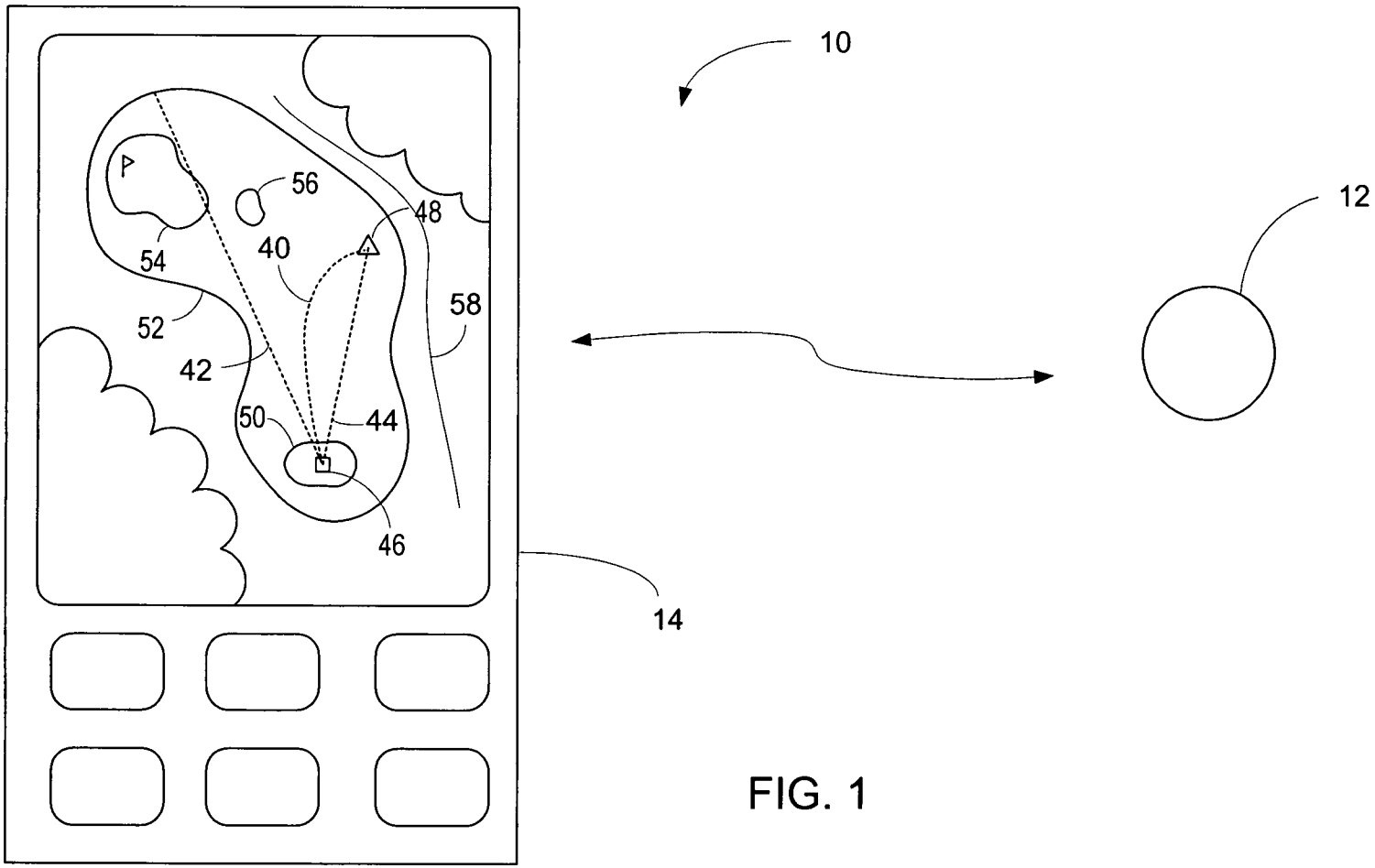
FIG. 1 is a schematic diagram of the data collection and analysis system of the present invention, including a ball and a handheld unit.

FIG. 1 illustrates a data collection and analysis system 10 for use in analyzing a person's performance in a sport, such as golf or baseball. The data collection and analysis system comprises a ball 12 and a handheld unit 14. The golf ball 10 acquires and transmits position data to the handheld unit 14. The handheld unit 14 processes the data and outputs performance results to the user. However, those skilled in the art will recognize that the present invention may be applied in any sport that uses a ball or other projectile, e.g. puck. Sports where the present invention may be used include to golf, baseball, football, soccer, billiards, bowling, and hockey. The exemplary embodiment described below represents one application of the invention applied to the game of golf.

Figure 2:
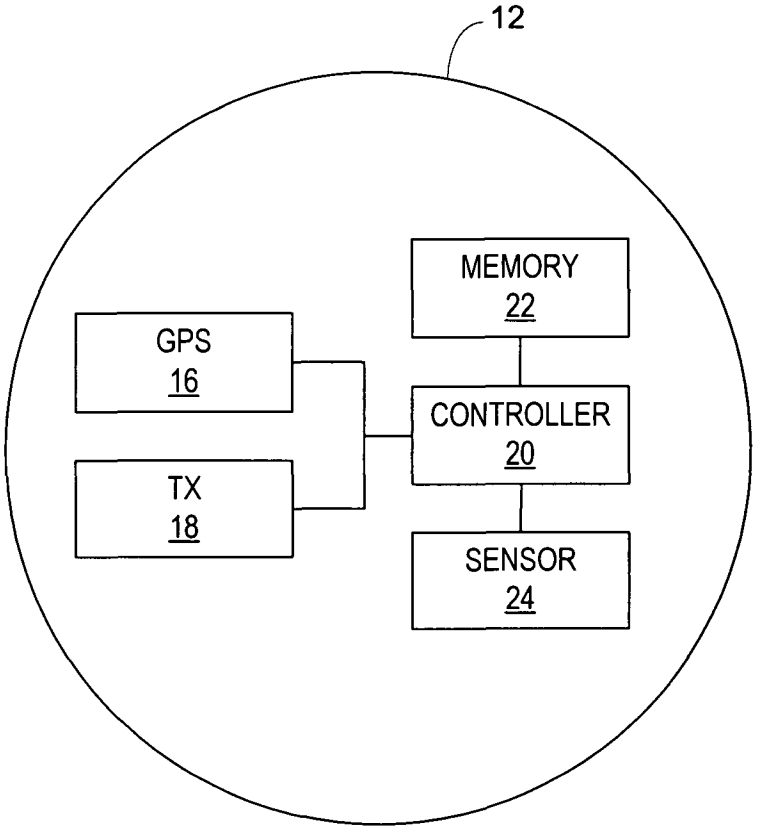
FIG. 2 is a block diagram illustrating a ball according to one exemplary embodiment of the invention.

FIG. 2 illustrates a golf ball 12 according to the present invention. The golf ball 12 comprises a GPS receiver 16 or other positioning receiver that receives position signals from a satellite or terrestrial station, a transmitter 18 connected to the positioning receiver 16 to transmit position data acquired by the positioning receiver 16 to the handheld unit 14, a controller 20, memory 22 and sensor 24. The positioning receiver 16 may for example, comprises a GPS receiver that acquires position data from position signals transmitted by earth-orbiting satellites. The positioning receiver 16 receives the position signals while the golf ball 12 is in flight or in motion to track the flight path or path of travel of the golf ball 12 after the golfer takes a stroke. The positioning receiver 16 outputs position data to the transmitter 18 for transmission to the handheld unit 14. The position data may be raw position data acquired by the GPS receiver or other positioning receiver 16, or may be processed data. The GPS receiver 16 may include a position processor to provide coordinate data or other processed position data to the hand-held unit 20. The transmitter 18 may comprise, for example, a conventional cellular radio transmitter. The controller 20, which may comprise a microprocessor, controls operation of the GPS receiver 16 and transmitter 18 according to program instruction stored in memory 22. Controller 20 may also process position data acquired by the GPs receiver 16 prior to transmission to the handheld unit 14. Memory 22 stores programs needed for operation. In addition, memory 22 may store position data prior to transmission to the handheld unit 14. Sensor 24 detects when the ball 12 is in motion. Sensor 24 may, for example, sense acceleration or motion of the ball 12 and generate an input signal to the controller 20. In one exemplary embodiment, the controller 20 controls the power to the GPS receiver 16 and transmitter 18 responsive to the sensor input. When the golf ball 12 is struck by a golf club, the controller 20 turns on the GPS receiver 16 and transmitter 18. The controller 18 may turn off the GPS receiver 16 and transmitter 18 after a predetermined period of time, or after the ball 12 comes to rest.

While the golf ball 12 is in motion, the GPS receiver 16 collects position data at a predetermined sampling interval. The position data may be used to track the path of travel of the golf ball 12 in three dimensions. The position data may be used by the golfer to analyze his or her golf strokes. Pertinent information that can be drawn from the position data includes, without limitation, distance, trajectory, presence of hooking and slicing, deviation from intended line of travel, etc.

Figure 3:
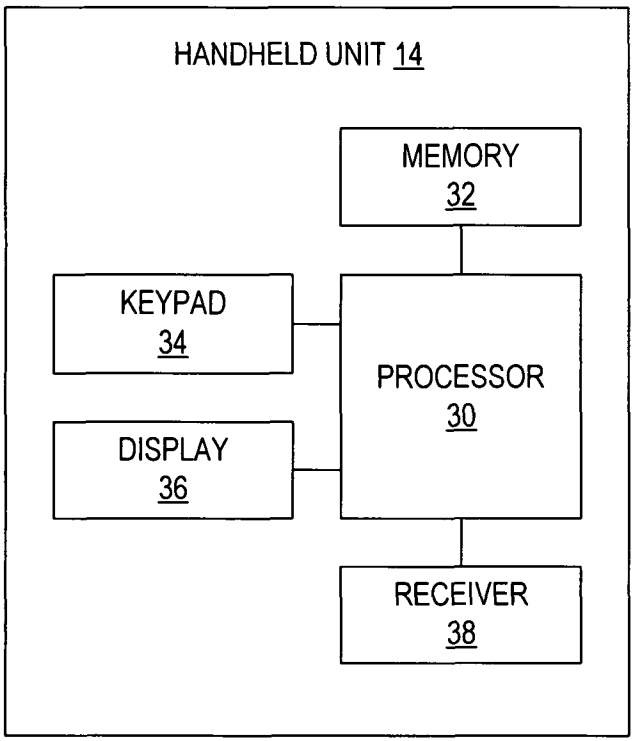
FIG. 3 is a block diagram illustrating a handheld according to one exemplary embodiment of the invention.

The hand-held unit 14, shown in FIG. 3, includes a processor 30 for processing the position data into a form useful to the golfer, memory 32 for storing course information, a keypad 34 to receive user input, a display 36 to output performance results to the user, and a receiver 38 to receive the position data from the ball 12. The display 36 may comprise an alphanumeric display or a graphic display, such as an LCD, showing graphical views of at least a portion of the golf course in either plan or elevation or both. The graphical views may include performance indicia, such as a line 40 showing the flight path or path of travel of the golf ball 12 and a separate line 42 showing the intended line of travel. The graphical view may further display a result line 44 for the last stroke showing the starting position 46 (square) and ending position 48 (triangle) of the golf ball. The graphic display may show golf course features, such as the tee box 50, fairway 52, green 54, hazards 56, and cart path 58. Distance from the current location of the golf ball 12 to such features may be displayed beside the features.

The handheld unit 14 may also calculate and display the route to the golf ball from the user's current position. Alternatively, or in addition, the hand-held unit 14 may generate a text output such as "Distance=250 yds, hook." Because the position data includes the ending position 48 of the golf ball 12, the hand-held unit 14 may also be used to locate a golf ball 12 following a golf stroke. The display may show the user's current position. To show the user's current position on the graphical display 36, the hand-held unit 14 may need to have a GPS receiver (not shown) or other positioning device. If the hand-held unit 14 does not have a graphical display, information concerning the final position of the golf ball 12 may be displayed as a vector, for example, "185°, 76 yards." The vector information specifies the direction and distance to the golf ball 12.

The hand-held unit 14 may store the position data for an entire round of golf and allow the user to play back the round at a later time to study how the game was played. The position data stored may include not only the starting and ending position for each stroke, but also position data showing the flight path or path of travel of the ball. The processor may generate animated sequences to replay the entire round for the user on display 36. The animated sequences may replay the round in plan view and/or elevation view. Also, the handheld unit 14 could store other information, such as the club selection for each stroke so that the user can analyze his or her performance using different clubs. The hand-held unit 14 could couple to a host computer that would allow more sophisticated processing of the position data.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A data collection system for tracking a ball in flight comprising:

a ball;

a positioning receiver disposed within the ball to receive position signals and to generate position data;

a transmitter disposed within the ball and coupled to the positioning receiver to transmit said position data; and a controller disposed within the ball to control the positioning receiver to collect position data indicative of the flight path of the ball at a plurality of sampling times while the ball is in flight.

2. The data collection system of claim 1 wherein the controller includes a sensor to detect when the ball is in flight.

3. The data collection system of claim 2 wherein said sensor comprises a motion detector.

4. The data collection system of claim 1 wherein the positioning receiver comprises a GPS receiver.

5. The data collection system of claim 1 further comprising a remote data collection unit including a receiver to receive the position data from the transmitter in the ball.

6. The data collection system of claim 5 wherein the data collection unit comprises a processor to process and analyze the position data.

7. The data collection system of claim 6 wherein the processor determines the flight path of the ball based on processing the position data received from the transmitter in the ball.

8. The data collection system of claim 7 wherein the remote data collection unit includes a display coupled to the processor to display flight path data to a user.

9. The data collection system of claim 8 wherein the display is an alphanumeric display and wherein the flight path data comprise alphanumeric output.

10. The data collection system of claim 9 wherein the flight path data includes the distance the ball traveled.

11. The data collection system of claim 9 wherein the flight path data includes the direction of travel of the ball.

12. The data collection system of claim 8 wherein the display is a graphic display and wherein the processor generates a graphical view of at least a portion of the golf course for output to said display.

13. The data collection system of claim 12 wherein the graphical view generated by the data collection system and output to the display includes the flight path of the ball.

14. The data collection system of claim 13 wherein the graphical view generated by the data collection system and output to the display includes both the starting point and the ending point of the flight path of the ball.

15. The data collection system of claim 14 wherein the graphical view generated by the data collection system and output to the display includes a result line extending between the starting point and the ending point.

* * * * *